US006863422B2

(12) United States Patent
Jesurun et al.

(10) Patent No.: US 6,863,422 B2
(45) Date of Patent: Mar. 8, 2005

(54) ERGONOMIC CONTROLS IN A SURGICAL LIGHTING SYSTEM

(75) Inventors: David Jesurun, S. Euclid, OH (US); Allan J. Greszler, Elyria, OH (US); Yury Keselman, Beachwood, OH (US); Terry A. Drabinski, Stow, OH (US); Steven H. Rus, Chardon, OH (US)

(73) Assignee: Steris Inc., Mentor, OH (US)

( * ) Notice: Subject to any disclaimer, the term of this patent is extended or adjusted under 35 U.S.C. 154(b) by 21 days.

(21) Appl. No.: 10/374,432

(22) Filed: Feb. 25, 2003

(65) Prior Publication Data

US 2003/0210559 A1 Nov. 13, 2003

Related U.S. Application Data

(60) Provisional application No. 60/359,490, filed on Feb. 25, 2002.

(51) Int. Cl.[7] ..... F21V 21/08

(52) U.S. Cl. ..... 362/399; 362/85; 362/394; 362/804; 362/295

(58) Field of Search ..... 362/399–400, 362/419, 285, 287, 269, 271, 85, 371, 804

(56) References Cited

U.S. PATENT DOCUMENTS

| | | | | |
|---|---|---|---|---|
| 1,918,845 A | * | 7/1933 | Hummert | 362/394 |
| 1,996,713 A | * | 4/1935 | Waltman | 362/395 |
| 2,069,816 A | | 2/1937 | Child | |

(List continued on next page.)

FOREIGN PATENT DOCUMENTS

| | | | | |
|---|---|---|---|---|
| DE | 43 35 254 A1 | | 10/1993 | |
| EP | 0 280 839 | | 9/1988 | |
| GB | 739621 | | 11/1955 | |
| GB | 819.836 | | 9/1959 | |
| GB | 2021751 A | * | 12/1979 | ..... F21V/23/04 |

OTHER PUBLICATIONS

PCT/US03/05489—Notification of Transmittal of the International Search Report or the Declaration.
International Search Report for International Application No. PCT/US 03/05498; Aug. 7, 2003.
International Publication No. 99/50593; Oct. 7, 1999.
International Publication No. WO 01/45627 A1: Jun. 28, 2001.
International Publication No. WO 01/45627 A1—Corrected Version: Jun. 28, 2001.

*Primary Examiner*—Alan Cariaso
*Assistant Examiner*—Ali Alavi
(74) *Attorney, Agent, or Firm*—Fay, Sharpe, Fagan, Minnich & McKee, LLP

(57) ABSTRACT

A lighting system (10) suited to use in an operating theater includes one or more lightheads, each having a housing (28) and a bezel (50) extending therefrom. A light source (38) is disposed within the housing. A handle (36) extends below the bezel and is rotatable relative thereto. A lighting control input means (60), associated with the bezel allows adjustment of the intensity of light emitted by the light source. A sterile cover (54) can be placed over both the handle and the bevel, allowing the input means to be manipulated by pressure on the cover with the thumb of the operator's hand, while simultaneously grasping the handle in the palm and fingers.

26 Claims, 8 Drawing Sheets

U.S. PATENT DOCUMENTS

| | | | | | |
|---|---|---|---|---|---|
| 2,173,325 | A | | 9/1939 | Alexander | |
| 2,297,781 | A | | 10/1942 | Korengold | |
| 2,632,098 | A | * | 3/1953 | Marchese | 362/395 |
| 3,360,640 | A | | 12/1967 | Seitz et al. | |
| 3,428,797 | A | | 2/1969 | Haynes | |
| 3,928,757 | A | | 12/1975 | Nelson | |
| 4,234,907 | A | | 11/1980 | Daniel | |
| 4,517,632 | A | * | 5/1985 | Roos | 362/389 |
| 4,581,689 | A | | 4/1986 | Oram | |
| 4,761,047 | A | | 8/1988 | Mori | |
| 5,165,786 | A | * | 11/1992 | Hubert | 362/287 |
| 5,339,223 | A | | 8/1994 | Kremenchugsky et al. | |
| 5,383,105 | A | | 1/1995 | Agut | |
| 5,539,626 | A | | 7/1996 | Scholz | |
| 5,820,253 | A | * | 10/1998 | Scholz | 362/267 |
| 6,132,062 | A | | 10/2000 | Borders et al. | |
| 6,402,351 | B1 | | 6/2002 | Borders et al. | |
| 6,644,837 | B2 | | 11/2003 | Borders et al. | |
| 6,692,141 | B2 | * | 2/2004 | Jesurun et al. | 362/399 |
| 6,715,904 | B2 | * | 4/2004 | Naughton | 362/399 |
| 2002/0089857 | A1 | * | 7/2002 | Borders et al. | 362/399 |

* cited by examiner

ERGONOMIC CONTROLS IN A SURGICAL LIGHTING SYSTEM

This application claims the benefit of U.S. Provisional Application Ser. No. 60/359,490, filed Feb. 25, 2002.

BACKGROUND OF THE INVENTION

The present invention relates to the surgical lighting and accessory control arts. It finds particular application in conjunction with controlling the intensity of light emanating from lightheads in an operating room (OR) setting and will be described with particular reference thereto. It is to be appreciated, however, that the invention also finds application in conjunction with controlling functions of other devices and is not limited to the aforementioned lighting application.

Typically, in an operating room setting, large, high lumen output lightheads are used to illuminate the surgical site. At certain times during an operation, it is appropriate for the surgeon to adjust the intensity of the light. For example, the surgeon may prefer a more intense overhead light to illuminate the operating region better, or the surgeon may desire to decrease the strength of the overhead light to reduce the effects of shadows or glare. In some situations, the overhead lamps are turned off completely so that smaller, local light sources can be used or to help surgeons view monitor screens and other equipment.

Light intensity controls in typical lighting systems are generally located in areas which are not directly accessible to the surgeon, such as on a non-sterile wall plate. To avoid potential contamination of the operating site, the surgeon requests a circulating nurse to adjust the non-sterile controls, as needed. This consumes both the nurse's time, and the surgeon's attention.

U.S. Pat. No. 6,402,351 discloses a lighting system in which the light intensity control is located on a distal end of a sterile handle of the lighthead. A single push button at the tip of the lighthead handle is used to allow the surgeon to control the intensity, cycling through discrete intensity levels with each push of the button. A primary disadvantage of this system, however, is that it is very awkward to use. The hand must be inverted in order to position the user's thumb under the push button on the bottom of the lighthead handle. Additionally, the push-button mechanism creates surfaces where blood can become lodged, making sterilization for subsequent procedures difficult. Still further, functionally, the single push button allows only unidirectional light level cycling.

The present invention provides new and improved ergonomic control methods and apparatus that overcome the above-referenced problems and others.

SUMMARY OF THE INVENTION

According to one aspect of the invention, a lighting system includes a lighthead. The lighthead includes a housing. A light source is disposed within the housing. A bezel extends from the housing. A handle is rotatable relative to the housing and is at least partially spaced from the housing by the bezel. Lighting control input means are associated with the bezel for adjusting an intensity of light emitted by the light source.

In accordance with another aspect of the present invention, a surgical light apparatus is provided. The light apparatus includes a housing. A light source is located within the housing. A handle is carried by the housing for selec tively focusing light from the light source. An actuator selectively adjusts an intensity of light emitted by the light source. The actuator is spaced from the handle such that the handle is removable from the housing without removing the actuator. A cover is selectively mountable on the handle such that the cover covers the actuator, whereby the actuator is operable by applying pressure on the cover adjacent the actuator.

In accordance with another aspect of the present invention, a surgical light apparatus of the type including a lighthead housing, a bulb located within the housing, a lens, a handle adjacent the lens, a bezel area between the handle and the lens, and a controller coupled to the bulb is provided. An ergonomic control apparatus includes at least one actuator on the bezel area for controlling a function effected by the controller.

In accordance with another aspect of the present invention, a method of adjusting illumination from a lighthead is provided. The method includes covering a handle of a lighthead with a sterile cover and manipulating the handle to adjust a pattern size of illuminated light from a housing of the lighthead on a subject. The method further includes manipulating an actuator through the sterile cover to adjust an intensity of the illuminated light, the actuator being spaced from the handle.

One advantage of at least one embodiment of the present invention is the provision of an easily accessible light intensity control.

Another advantage of at least one embodiment of the present invention is that the intensity control switches are located on the bezel area of a surgical lighthead.

Another advantage of at least one embodiment of the present invention is that the handle is removable from the bezel without the need for disconnecting mechanical or electrical connections between the intensity control switches and the light source.

Still further advantages and benefits of the present invention will become apparent to those of ordinary skill in the art upon reading the following detailed description of the preferred embodiment.

BRIEF DESCRIPTION OF THE DRAWINGS

The invention may take form in various components and arrangements of components, and in various steps and arrangements of steps. The drawings are only for the purpose of illustrating preferred embodiments and are not to be construed as limiting the invention.

DETAILED DESCRIPTION OF THE PREFERRED EMBODIMENTS

Figure 1:
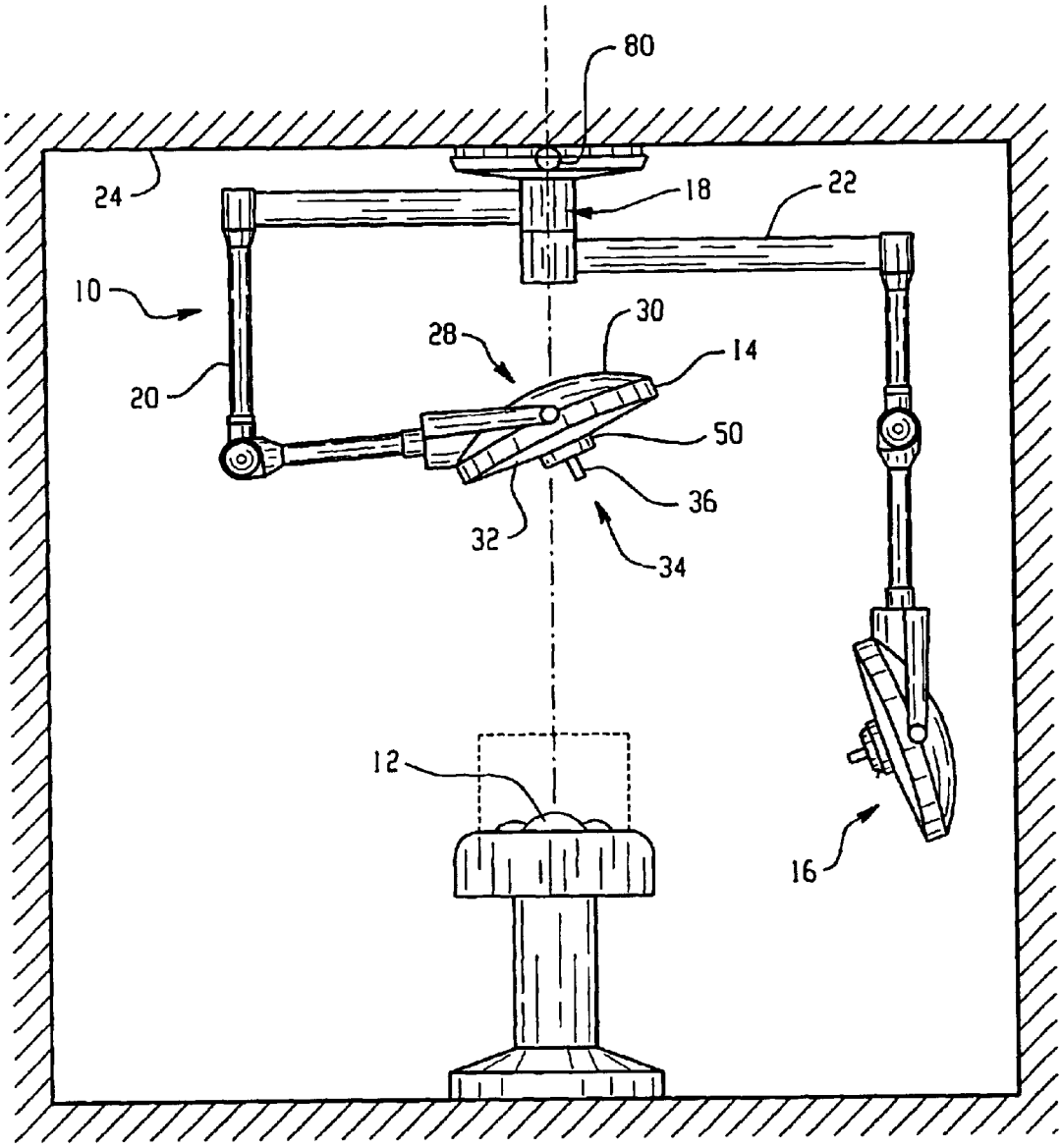
FIG. 1 is a perspective view of a lighting system including a pair of lightheads connected to a suspension system in accordance with an embodiment of the invention.

With reference to FIG. 1, an overhead lighting system 10 suited to use in an operating room illuminates areas of a patient 12 undergoing surgery. The system 10 illustrated in FIG. 1 includes two lightheads 14, 16, which are suspended from a common mounting system 18 by articulated arm assemblies 20, 22, respectively. The arm assemblies allow the lightheads to be independently movable to a variety of positions relative to a ceiling 24 and the patient. The lighting system 10 is rigidly mounted to a suitable stationary support, such as a beam (not shown), typically located above the ceiling. As will be appreciated, the lighting system 10 may also include other medical devices, such as task lights, monitors, cameras, and the like (not shown).

Figure 2:
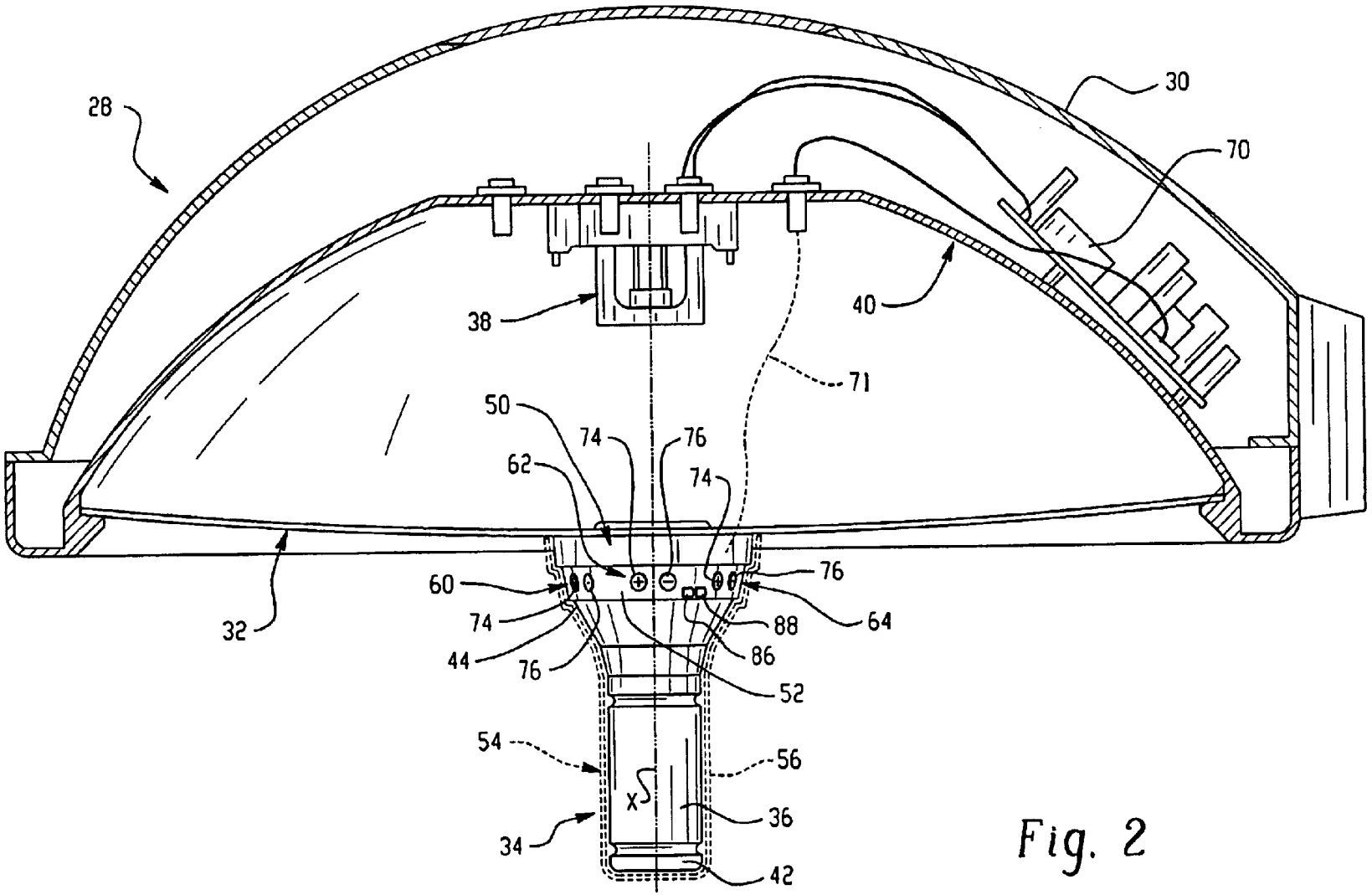
FIG. 2 is a side view, in partial section of one of the lightheads of FIG. 1.
Figure 3:
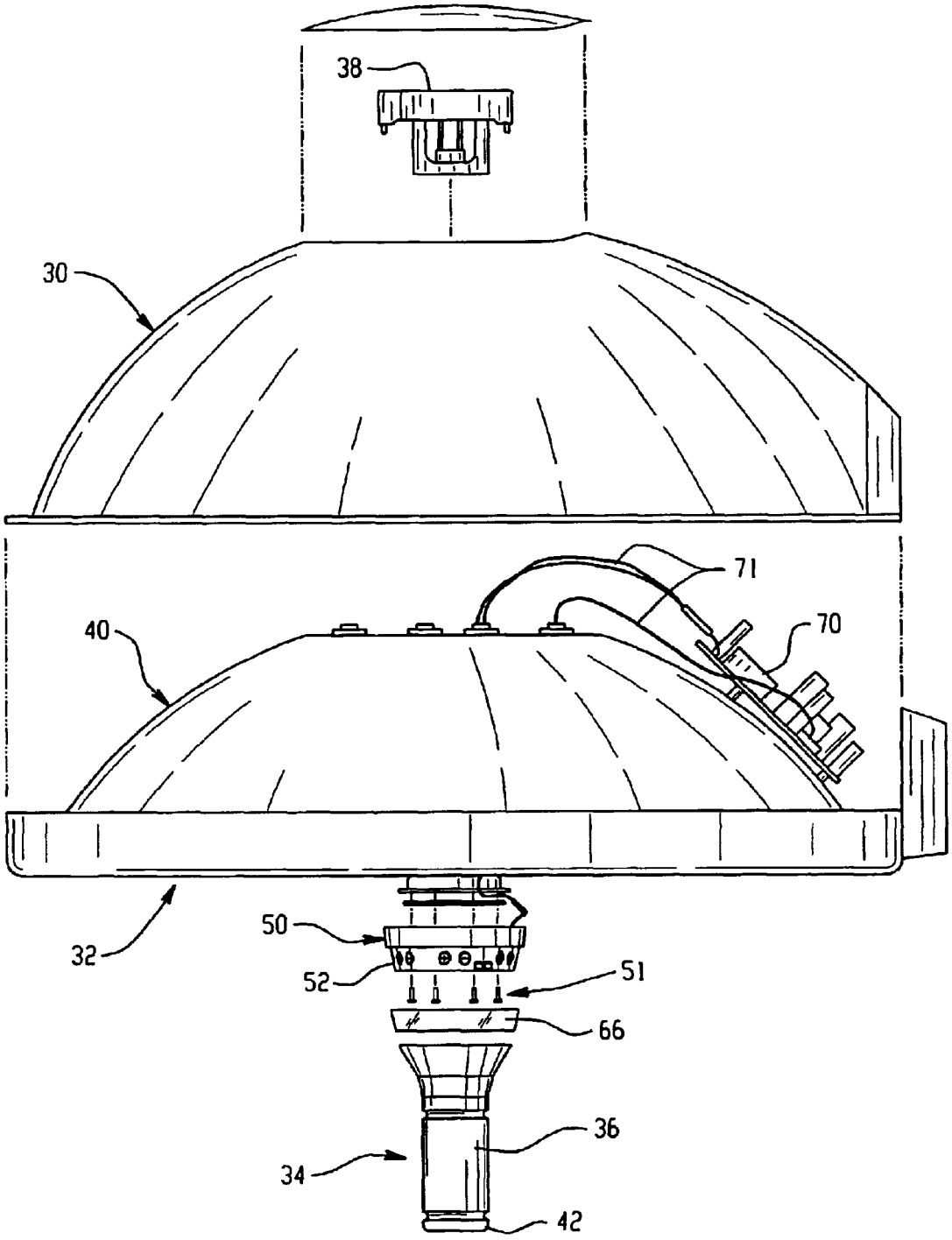
FIG. 3 is an exploded perspective view of the lighthead of FIG. 2.

Each lighthead 14, 16 includes a housing 28 including a dome-shaped cover or shell 30, a lens system 32, through which the light shines from the respective lighthead, and a handle assembly 34, shown in detail in FIGS. 2 and 3. To maneuver a lighthead to a suitable location, a surgeon grasps a handle 36 of the handle assembly 34 and pulls the lighthead to the desired position. The housing shell 30 and lens system 32 together enclose a light source 38, such as one or more light bulbs or fiberoptic member. A reflector 40 directs the light from the light source 38 through the lens system 32. In one embodiment, the lens system 32 includes two or more lenses, which are moved relative to each other, to adjust the focus of the light on the patient, e.g., by decreasing or increasing the diameter of the light pattern on the patient. While the description refers to lighthead 14, shown in FIG. 2, it will be appreciated that the description applies as well to lighthead 16.

The handle 36 is in the form of a generally cylindrical hollow shaft, which may be widened or otherwise shaped at its closed distal end 42 for ease of handling. The upper or proximal end of the handle widens to form a lip 44. A bezel or escutcheon 50 is mounted to or otherwise formed on the lighthead housing 28 such that it is located intermediate the housing and the handle 36. For example, the bezel is mounted to the lighthead by bolts, screws, adhesive, or other suitable fixing means 51. In the illustrated embodiment, four screws 51 are used to attach the bezel to the lighthead, as will be described in greater detail below.

The bezel 50 includes a frustoconically shaped distal end 52, which is adjacent to or in contact with the lip 44 of the handle 36. The handle 36 is rotatable, relative to the bezel 50, about an axis X through the lighthead, to adjust the focus of the lamp 38. The beam pattern emanating from the lighthead is thus adjusted by twisting the handle 36. By rotating the handle 36, the pattern size of the illuminated light on the patient can be increased or decreased. The handle 36 can be rotatably mounted to the lighthead via a suitably positioned central opening 53 in the bezel 50, best shown in FIG. 4, and described in further detail below.

Figure 5:
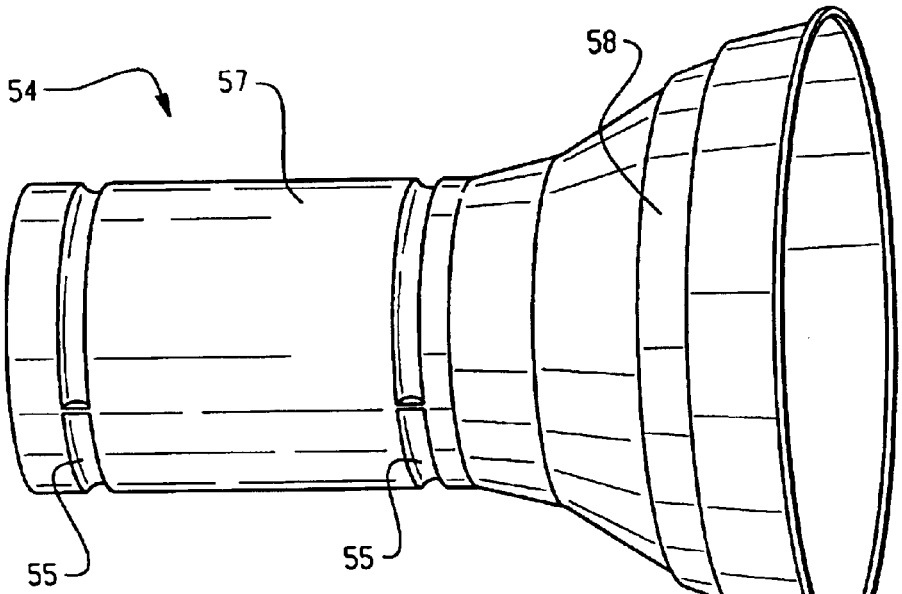
FIG. 5 is a perspective view of the sterile cover of FIG. 2.

A disposable sterile cover 54 (shown in phantom in FIG. 2 and in perspective view in FIG. 5) surrounds both the handle 36 and the bezel 50. Gripping regions 55 of the cover cooperate with corresponding regions (not shown) on the handle 36, to inhibit the cover from falling off the handle and to resist relative rotational movement between the cover and the handle, when the surgeon desires to twist the handle. The cover 54 has a sterile or highly disinfected outer surface 56 which the surgeon can handle repeatedly without risk of contaminating the surgeon's hands. When the surgeon grasps and rotates the handle 36, the cover 54 rotates along with the handle. The cover includes a generally cylindrical base portion 57, which covers the base 42, and sides of the handle 36, and a widened upper portion 58, which covers the widened upper portion 44 of the handle and the bezel 50.

Lighting control input means 60, such as a plurality of membrane switches, are located on the bezel 50 of the lighthead handle assembly and serve as an actuator for the light source 38. The control input switches 60 are positioned to enable the surgeon to operate the switches while maintaining sterile technique by depressing the switches through the disposable cover 54. Specifically, at least the upper portion 58 of the cover is sufficiently flexible or movable such that pressure on the cover adjacent the switches 60 allows the operation of the switches beneath. The cover is preferably formed from a transparent material so that the locations of the switches are readily visible therethrough.

The switches 60 are used to control the intensity of the light emanating from the lighthead. When the surgeon loosely grips the handle with the palm and fingers of the hand, the thumb is suitably positioned to depress the switches on the bezel above the handle. The relative position between the switches and the handle has ergonomic advantages and makes the switches extremely easy to operate and convenient to use.

As shown in FIG. 2, several sets 60, 62, 64 of the switches (four sets in a preferred embodiment) are circumferentially spaced around the bezel 50 so that a set of switches is readily accessed irrespective of the rotational position of the surgeon's hand. Additionally, a transparent flexible annular membrane 66, formed from plastic or rubber, covers all of the switches 60 to provide an outer surface 68 which is easy to keep clean but which is sufficiently flexible to allow the switches to be actuated therethrough.

In one embodiment, the switches 60 are in the form of push buttons operable for an incremental increase or decrease in the light intensity with each successive depression of the button. The push buttons are operatively connected with a suitable controller 70, for example, by suitable electrical wiring 71. The controller is adapted to receive inputs from the buttons and react to those inputs to regulate the power supplied to the respective light source 38 of the lighthead to adjust the light intensity. The controller 70 may be located within the housing 28, such as between the reflector 40 and the dome 30, as illustrated in FIG. 3, or located elsewhere, such as in the bezel 50, or spaced from the lighthead 14, 16 and electrically connected thereto.

In the embodiment of FIG. 2, each set of switches 60, 62, 64 includes a first push button 72, which, when depressed, causes an increase in the light intensity between a low intensity and a maximum intensity. When the light emanating from the lighthead is at its maximum intensity available, the controller 70 maintains the setting so that further pressing the increase intensity button 72 has no effect.

A second push button 76 in each set 60, 62, 62 is a decrease intensity button, which when actuated, causes the light emanating from the light source 38 of the lighthead to decrease in intensity when depressed. When the lighthead reaches its lowest intensity setting (a low level light), lightly depressing the decrease intensity button 76 has no effect. However, if the button 76 is held in the depressed state for a predetermined period of time, such as about 1–2 seconds, the light source 38 is switched off. Preferably, the controller 70 actuates an ambient light 80, contemporaneously with switching off the lighthead 14. The ambient light is spaced from the lighthead 14, 16 and provides overall low level room illumination.

FIG. 1 shows the ambient light 80 associatively coupled with the mounting system 18, although other locations for the ambient light are also contemplated. In one embodiment, switching one of the lightheads 14 to off by the selectable lengthy time depression also switches off the other lighthead 16, regardless of its current intensity setting. Other arrangements are contemplated. For example, sustained holding of the decrease button 76 for a first time period, e.g., one (1) second, switches off just the associated lighthead 14, while depression for an additional selectable time period, e.g., two to four (2–4) seconds, turns off all of the lightheads associated with the controller 70 and turns on the overhead ambient light 80. The selectable delay interval time periods and other system parameters are preferably programmed into the controller software and are adjustable by changing or modifying the software. Alternatively, the time intervals are selectable from an input device associated with the controller 70.

Figure 6:
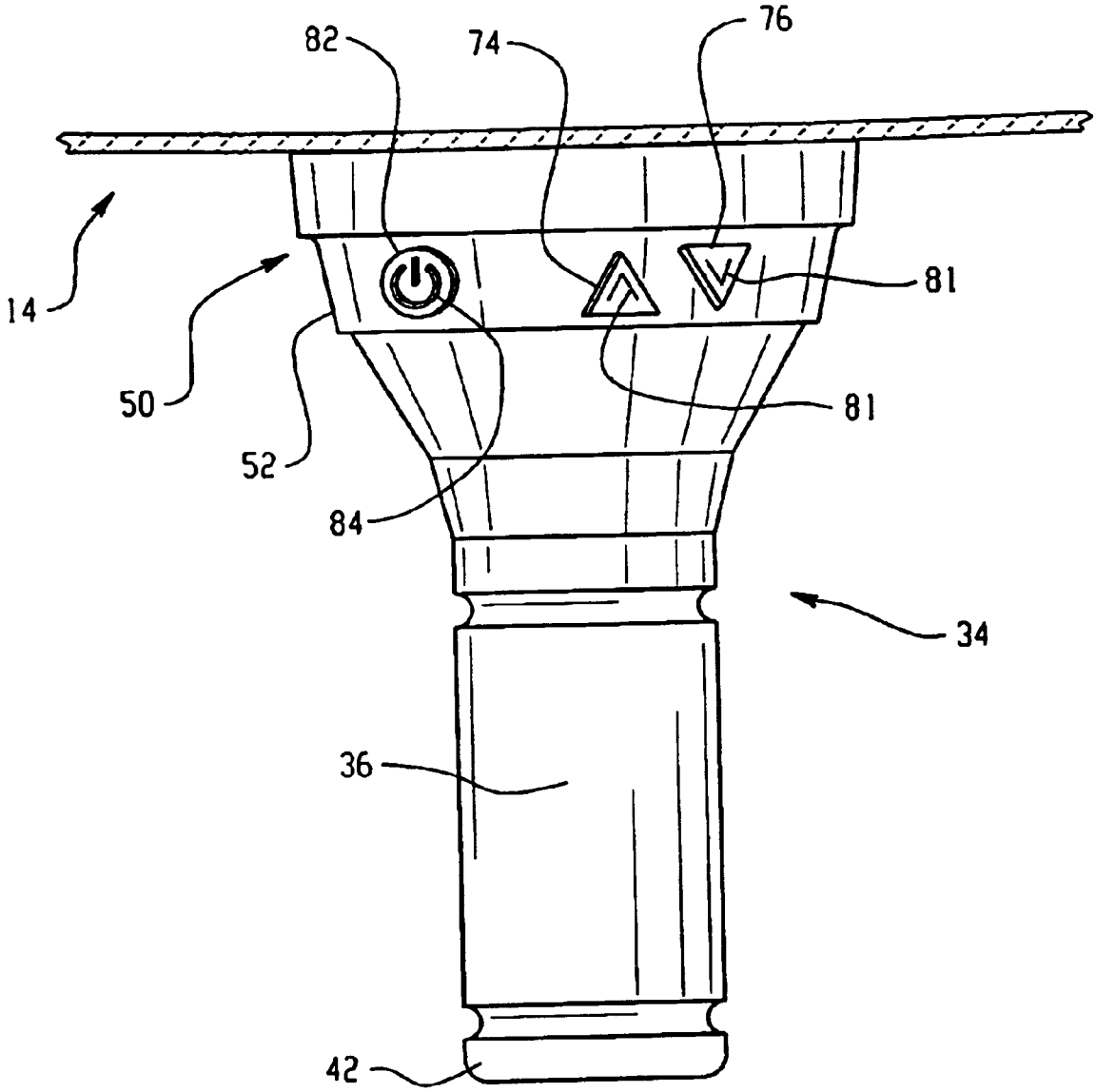
FIG. 6 is an enlarged perspective view of the handle and bezel of an alternative embodiment of a lighthead according to the present invention.

The buttons 74, 76 are suitable marked as desired with a visual indicator 81, such as a plus (+) or minus (–) symbol, as shown in FIG. 2 to denote their function. Preferably, the buttons are molded with raised indicators to provide for ready tactile recognition when the lighting level is low. The tactile differences also assist the surgeon in distinguishing the buttons when attention is focused elsewhere. Alternatively or additionally, as shown in FIG. 6, the two buttons 74, 76 are shaped differently (oppositely pointing triangles in the illustrated embodiment), to facilitate identification by touch. Each of the buttons 74, 76 has a raised indicator 81 (v for decreasing intensity, ∧ for increasing intensity in the illustrated embodiment).

Optionally, a separate power switch 82 is provided for switching the light source 38 on or off at any time. The power switch 82 is optionally mounted on the bezel 50, adjacent the switches 74, 76, as shown in FIG. 6. There may be more than one power switch 82, as for the other switches 74, 76. The power switch 82 is preferably readily distinguished, both visually and by touch, from the other switches. In the illustrated embodiment it is different in color (e.g., red, blue, or green) from the switches 74, 76 and has a different shape-round, rather than triangular. A raised power symbol portion 84 is included in the center, for visual and tactile distinction. In one embodiment, the power button 82 acts as a toggle switch. If it is depressed when the lighthead 14 is on, it turns the lighthead off. If it is depressed when the lighthead 14 is off, it turns the lighthead on. In the illustrated embodiment, the power button 82 has the ability to control other lightheads 16 and/or other equipment as well. If the lightheads are on, and the power button 82 is depressed and held in a depressed condition for an extended period, then all the lightheads 14, 16 are turned off by the associated controller 70. If the lightheads 14, 16 are off, and the power button 82 is depressed and held, all the lightheads are turned on. For example, all the lightheads are toggled if a power button is held for two (2) seconds. The time period for the function delay can be adjusted as desired.

The controller 70 is adapted to receive input signals from the buttons 74, 76, 80 and respond to those signals to regulate the power to the respective lighthead light source 38 to effect the desired operational function. In one embodiment, additional control means, such as push buttons 86, 88, are provided and are similarly connected to the controller to control devices and apparatus other than the associated lighthead such as, for example, video, audio, and other equipment.

The physical location of the switches 74, 76, 82 on the bezel 50 has several advantages. First, it allows the switches to be covered by the thin flexible upper portion 58 of the disposable sterile cover 54 and thus remain outside the sterile field to enable activation of the switches without direct sterilization. Second, it permits a mechanical separation between the handle and the lighthead to allow the handle 36 to be readily removable from the bezel 50. Placing all the electrical connections within the bezel region allows them to remain with the lighthead 14 when the handle removed for sterilization. The handle can thus be subjected to repeated high level sterilization processes without posing risk of damage to electrical components. Third, placement of switches on the bezel is an ergonomically beneficial arrangement on a surgical lighthead which allows for ease of operation. The handle 36 can be loosely grasped while the switches 74, 76, 82 are comfortably activated using the natural motion of the upwardly extended thumb.

The location of the buttons 74, 76, 84 on the bezel 50 allows the entire handle 36 and bezel 50 to be covered by a single disposable sterile cover 54. The preferred cover 54 is thin and easily slides over the handle 36, covering the entirety of the exposed portions of the bezel 50. This allows the surgeon to have immediate access to the lighting controls through the sterile cover while maintaining a sterile operating field. The cover, being disposable, is simply discarded after a surgery. The sterile cover 54 provides an interface between the sterile field on one side of the cover and non-sterile items on the non-sterile bezel 50. The bezel controller 70 is preferably separate from and not part of the removable lighthead handle 36 and need not be sterile.

In another embodiment, the sterile cover covers the handle 36 but not the bezel, the bezel being sterilized prior to a surgical operation by wiping the surface 68 with a sterilant or disinfectant.

Figure 7:
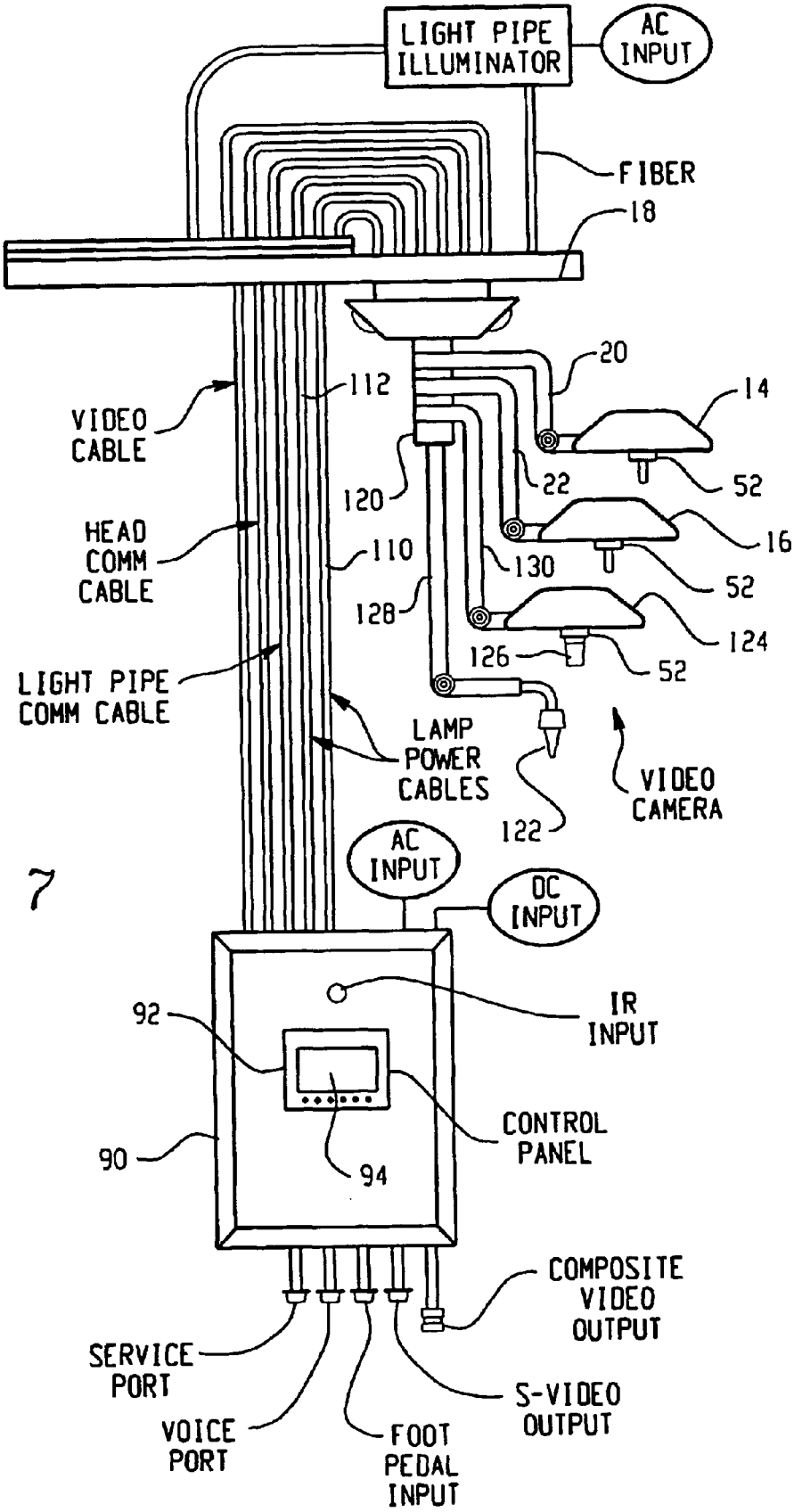
FIG. 7 is a schematic view of a lighting system and master control unit according to another embodiment of the invention.
Figure 8:
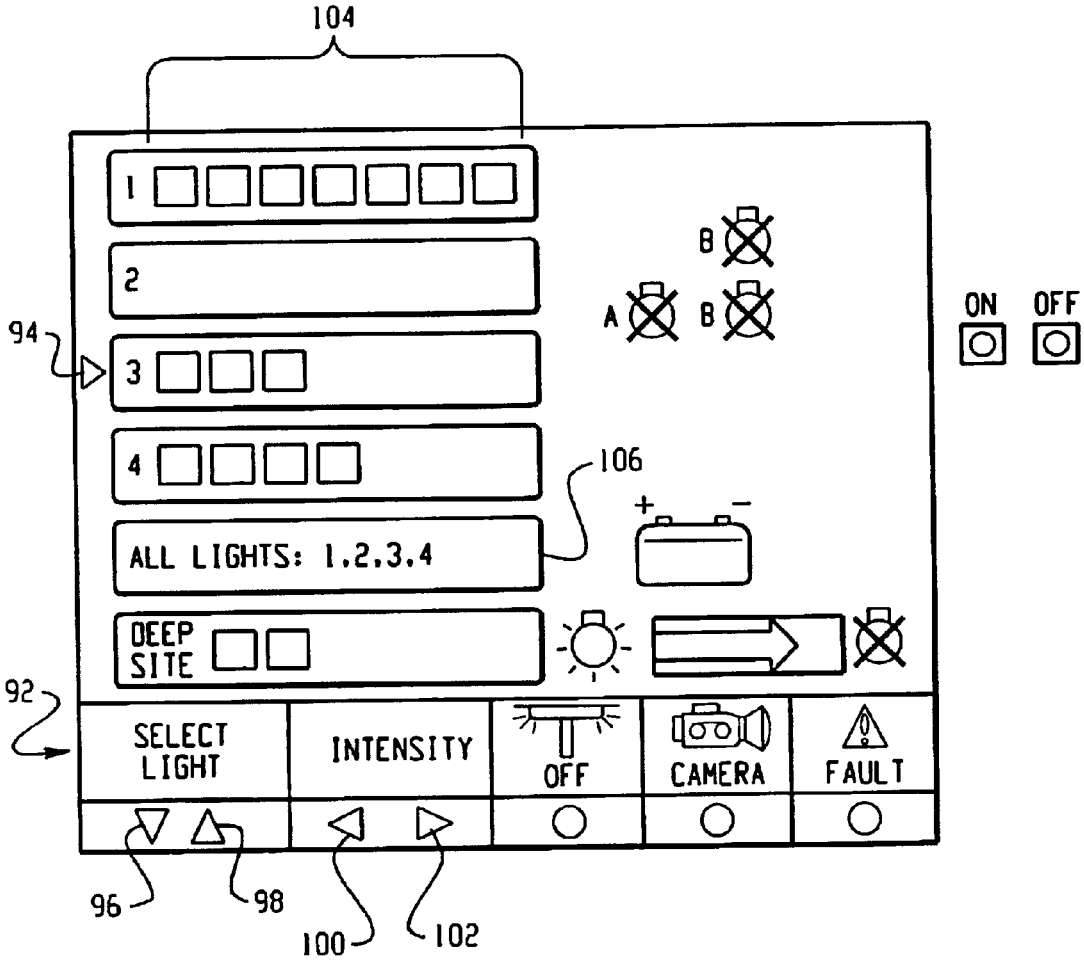
FIG. 8 is an enlarged view of the control panel of FIG. 7.

With reference also to FIGS. 7 and 8, a master control unit 90 is in communication with each of the lightheads 14, 16. The master control unit 90 may be mounted on a wall of the operating theater or at any other convenient location and includes a control panel 92, shown in greater detail in FIG. 8, for independently controlling each of the lightheads and other components of the system 10. The control panel includes a display screen 94 and a series of manually operable switches by which the lightheads and other components can be controlled. For example "select light" switches 96 and 98 allow an operator to toggle through the various lightheads (numbered 1–4 on the display panel) and select one of the lightheads. The operator can then use the intensity switches 100, 102 to vary the intensity of the light output on the selected lighthead. The intensity switches 100, 102 may be toggle switches which operate in a similar manner to intensity buttons 74, 76, sending signals to the controller 70. Either one of the switches of the master control unit 90 and the switches of the lighting control input means 60 can override the instructions of the other by being the latest in time to send a signal. A series of illuminated LED bars 104 associated with each lighthead on the display screen 94 provides an indication of the intensity of the light between zero (no bars illuminated), as in the case of lighthead No. 2, and maximum intensity (seven bars), as in the case of lighthead No. 1, in the illustrated embodiment. A function 106 labeled "all lights" allows all of the lightheads 14, 16 to be set to the same setting.

As shown in FIG. 8, communication cables 110, 112 extend between the master control 90 and the controller 70 in each lighthead for carrying signals therebetween. For example, when the controller 70 of one lighthead 14 receives a signal from the switch 76 to switch off the bulb 38 and also that of the other lighthead 16, the controller sends a signal to the master control unit 90, which in turn signals the controller of the lighthead 16 to switch off the bulb of that lighthead. The master control unit 90 also signals the ambient light 80 to switch on. These operations are carried out simultaneously, or substantially so, such that the operating room is not plunged in darkness for any significant length of time.

By way of example, FIGS. 7 and 8 illustrate the subject ergonomic controls in a system 10 in which lightheads 14, 16 are mounted to a common hub 120 of the support system 18. A task light 122 and a lighthead 124 with a camera attachment 126 are also mounted to the common hub 120 by arm assemblies 128, 130. It will be appreciated that these and a variety of other components may all be controlled from the master control unit 90 as well as having separate, independent controllers associated with each component 14, 16, 122, 124.

Figure 4:
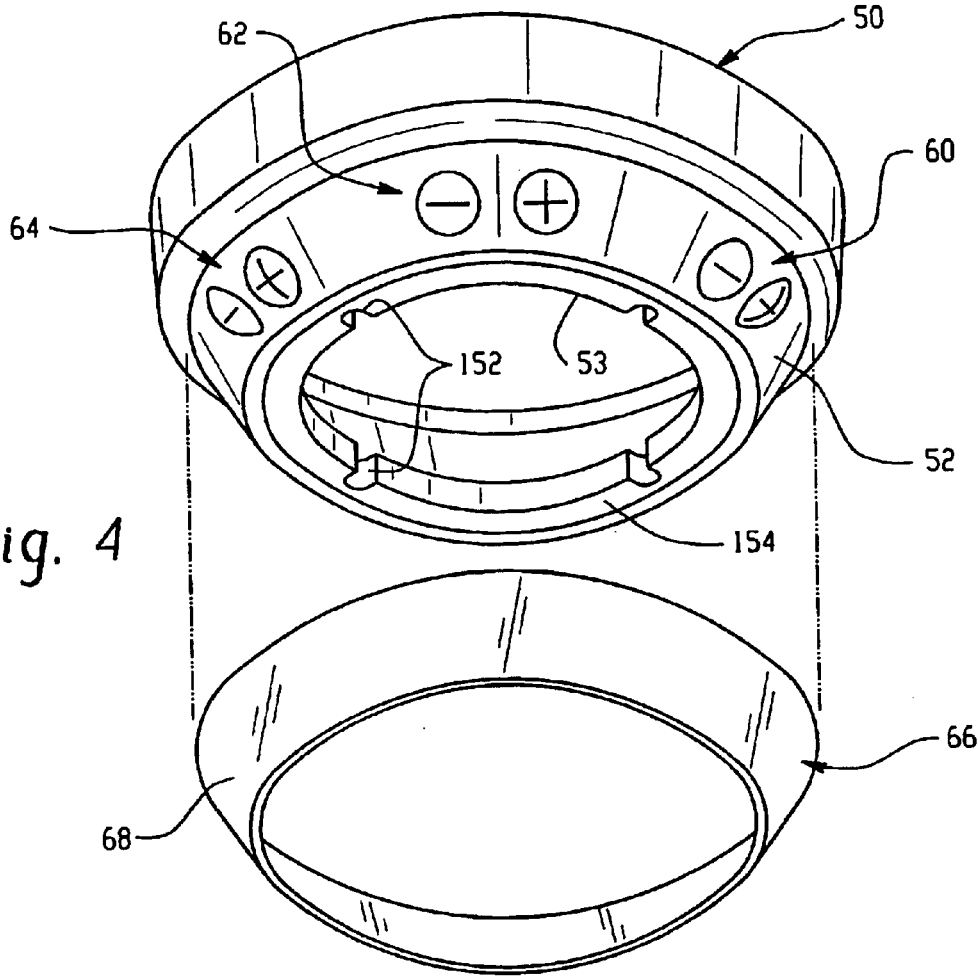
FIG. 4 is an enlarged perspective view of the bezel and bezel membrane of FIG. 3.
Figure 9:
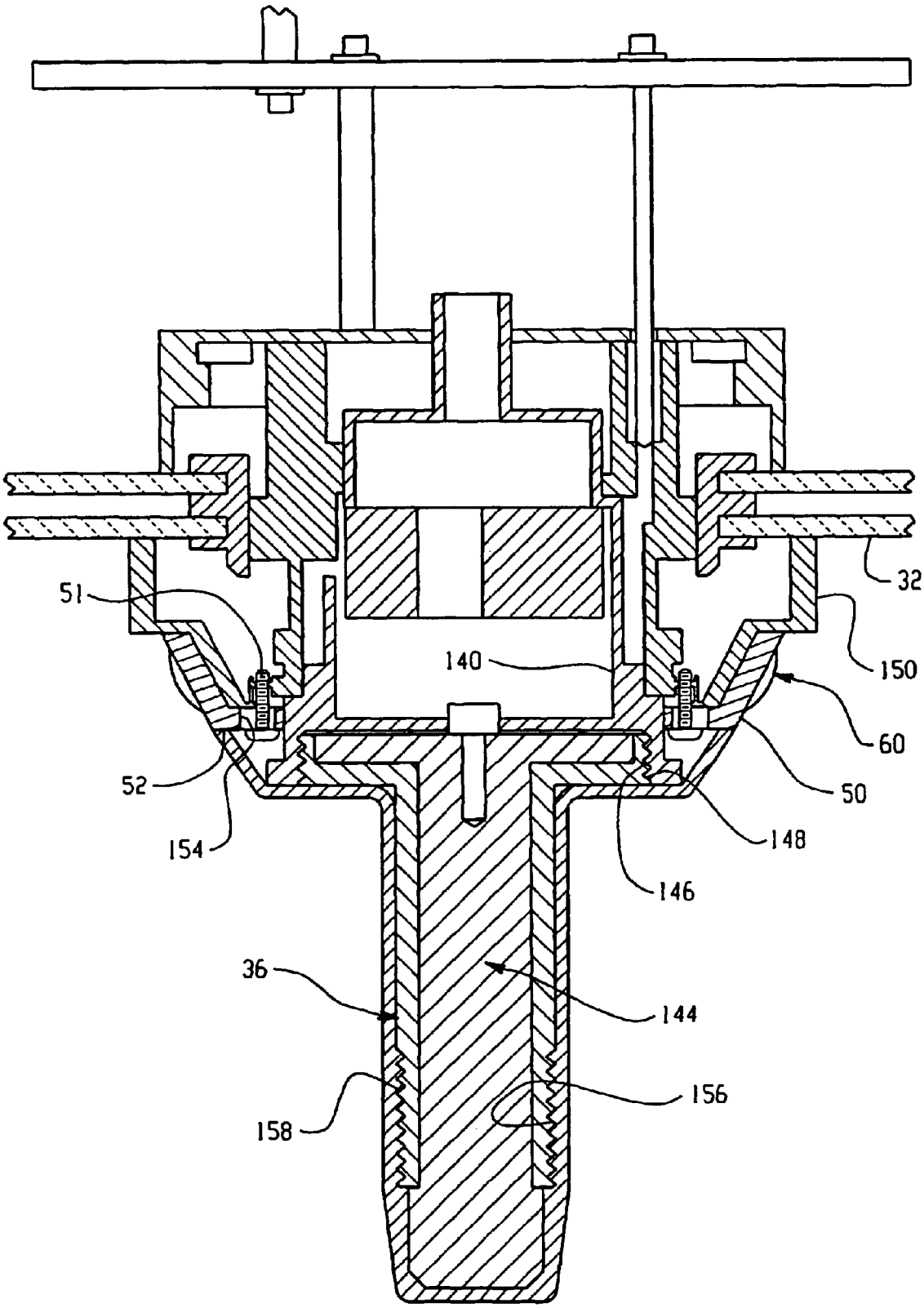
FIG. 9 is a side sectional view of the bezel and handle mounted to a gearbox of the lighthead of FIG. 1.

With reference now to FIG. 9, and reference also to FIGS. 3 and 4, the bezel 50 and handle 36 are assembled on the lighthead, preferably as follows. The lighthead is fitted with a gearbox 140, which extends below the lens 32. A handle subassembly 144 is mounted to the gearbox 140. Specifically, threads 146 on the handle subassembly engage corresponding threads 148 on the gearbox 140. The bezel 50, with the membrane 66 attached, is mounted to a stationary housing 150 of the gearbox 140 using the screws 51 or other suitable fixing members. Keyhole slots 152 are formed on an inwardly extending rim 154 of the distal end 52 of the bezel, adjacent the opening 53, best shown in FIG. 4. The slots 152 receive the screws 51 therethrough.

The wiring 71 from the bezel actuators 60, 62, 64 is connected with the controller 70. The handle subassembly 144 extends through the opening 53 in the bezel and is exteriorly threaded at 156. The handle 36 is interiorly threaded with corresponding threads at 158 which threadably engage the threads 156 as the handle is mounted on the handle subassembly 144. The lip 44 at the upper end of the handle covers the heads of the screws 51 and is seated against the distal end 52 of the bezel. Finally, the sterile cover 54 is pushed on to the handle 36 and bezel 50. The handle 36 can be readily removed from the handle subassembly 144, for sterilization, by rotating the handle to disengage the threads 158 from the subassembly threads 156.

When the surgeon grasps and turns the handle 36, the handle and subassembly. 144 rotate, conveying the rotation to the gearbox 140, which, in turn, adjusts the focus of the light from the lamp 38 on the patient. This adjustment may be achieved by adjusting the position of the lamp 38 relative to the reflector 40 or by adjusting the focusing of the lens system 32.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A lighting system comprising:

a lighthead including:

a housing;

a bezel extending from the housing;

a light source disposed within the housing;

a handle for controlling operational variables of the light head and at least partially spaced from the housing by the bezel; and lighting control input means, on the bezel, for adjusting an intensity of light emitted by the light source.

2. The lighting system of claim 1, wherein the lighting control input means includes at least one switch for selectively adjusting the intensity of light emitted by the light source in incremental amounts.

3. The lighting system of claim 1, further comprising:

a controller operatively coupled between the lighting control input means and the light source and adapted to control the intensity of light emitted from the light source in response to actuation of the lighting control input means.

4. The lighting system of claim 3, wherein:

the controller is adapted to modify the intensity of light emitted from the light source in response to successive actuations of the lighting control input means in predefined increments of light intensity.

5. A lighting system comprising:

a lighthead including:

a housing;

a bezel extending from the housing;

a light source disposed within the housing;

a handle rotatable relative to the housing and at least partially spaced from the housing by the bezel;

lighting control input means, on the bezel, for adjusting an intensity of light emitted by the light source, the lighting control input means including:

a first switch, actuation of the first switch increasing the intensity of the light emitted from the light source a selected amount between lower and upper intensity levels; and a second switch, actuation of the second switch decreasing the intensity of the light emitted from the light source by a selected amount between upper and lower intensity levels; and a controller operatively coupled between the lighting control input means and the light source and adapted to control the intensity of light emitted from the light source in response to actuation of the lighting control input means.

6. The lighting system of claim 5, wherein the controller switches off the light source in response to a prolonged actuation of the second switch when the intensity of the light is at the lower intensity level.

7. The lighting system of claim 5, wherein the controller applies power to an ambient lighting device, spaced from the lighthead, in response to a prolonged actuation of the second switch when the intensity of the light is at the lower intensity level.

8. The lighting system of claim 6, wherein the controller applies power to the ambient lighting device in response to the prolonged actuation of the second switch substantially simultaneously with switching off the light source.

9. The lighting system of claim 5, wherein the lighting control input means includes:

a third switch, actuation of the third switch turning the light source off when the light source is on, actuation of the third switch turning the light source on when the light source is off.

10. The lighting system of claim 1, wherein the handle is removable from the lighthead without disconnecting electrical connections between the lighting control input means and the light source.

11. The lighting system of claim 3, wherein the controller is adapted to increase the intensity of light emitted from said light source in predefined increments of light intensity in response to each actuation of the lighting control input means.

12. The lighting system of claim 2, further comprising:

a second lighthead housing;

a second light source disposed within the second lighthead housing, and wherein:

the controller is electrically coupled to the second light source and is adapted to control an intensity of light emitted from the second light source in response to selected actuations of the lighting control input means.

13. The lighting system of claim 12, wherein the second lighthead includes a second lighting control input means, operatively connected with the second light source by a second controller, for adjusting an intensity of light emitted by the second light source, each of the first and second lighting intensity control means being operable to switch off the light source of the lighthead associated with the other of the first and second lighting intensity control means.

14. The lighting system of claim 12, wherein the first and second lightheads are each mounted to a common support by an articulated arm.

15. The lighting system of claim 1, wherein the lighting intensity control means includes at least one actuator for controlling operation of at least one of the group consisting of video equipment and audio equipment.

16. The lighting system of claim 1, further comprising:

a sterile cover selectively mountable on the handle and bezel such that the cover covers the lighting intensity control means, the lighting intensity control means being operable through the cover.

17. A lighting system comprising:

a lighthead including:

a housing;

a bezel extending from the housing;

a light source disposed within the housing;

a handle rotatable relative to the housing and at least partially spaced from the housing by the bezel;

lighting control input means, on the bezel, for adjusting an intensity of light emitted by the light source;

a gearbox for focusing the light from the light source, the gearbox being mounted to the housing; and a handle subassembly mounted to the gearbox, rotation of the handle being conveyed to the gearbox by the handle subassembly, the handle subassembly extending through an opening in the bezel, the handle being removably mounted to the handle subassembly.

18. A surgical light apparatus comprising:

a housing;

a light source located within the housing which emits light;

a handle carried by the housing adapted for grasping for moving the housing into a selected position;

an actuator for selectively adjusting an intensity of light emitted by the light source, the actuator being spaced from the handle, such that the handle is removable from the housing without removing the actuator; and a cover, selectively mountable on the handle to cover the actuator, whereby the actuator is operable by applying pressure on the cover adjacent the actuator.

19. The surgical light apparatus of claim 18, further comprising:

a controller operatively coupled between the actuator and the light source which controls the intensity of the light source in response to an actuation of the actuator.

20. The surgical light apparatus of claim 18, wherein the lighthead includes a reflector, a lens, and a bezel area between the handle and the lens, the actuator being located on the bezel area.

21. In a surgical light apparatus of the type including a lighthead housing, a bulb located within the housing, a lens, a handle adjacent the lens, a bezel area between the handle and the lens, and a controller coupled to the bulb, an ergonomic control apparatus comprising:

at least one actuator on said bezel area for controlling a function effected by the controller.

22. The surgical light apparatus of claim 21, wherein the at least one actuator is adapted to control functions of medical equipment.

23. The surgical light apparatus of claim 21, wherein the at least one actuator is adapted to control an illumination level of the bulb.

24. The surgical light apparatus of claim 23, wherein the at least one actuator is also adapted to control an illumination level of an associated ambient light device.

25. A method of adjusting illumination from a lighthead, the method comprising:

covering a handle of the lighthead with a sterile cover;

manipulating the handle to adjust a pattern size of illuminated light from a housing of the lighthead on a subject; and manipulating an actuator through the sterile cover to adjust an intensity of the illuminated light, the actuator being spaced from the handle.

26. The method of claim 25, wherein the actuator is positioned intermediate the housing and the handle such that the handle is removable from the housing without removing the actuator, the method further including, prior to the step of covering the handle:

sterilizing the handle; and mounting the handle on the lighthead.

* * * * *